US011691373B2

(12) United States Patent
Tanaka et al.

(10) Patent No.: US 11,691,373 B2
(45) Date of Patent: Jul. 4, 2023

(54) PAPER LID PRODUCTION METHOD

(71) Applicant: TOKAN KOGYO CO., LTD., Tokyo (JP)

(72) Inventors: Yusuke Tanaka, Tokyo (JP); Yoshito Hisatomi, Tokyo (JP); Taroh Monden, Tokyo (JP)

(73) Assignee: TOKAN KOGYO CO., LTD., Tokyo (JP)

( * ) Notice: Subject to any disclaimer, the term of this patent is extended or adjusted under 35 U.S.C. 154(b) by 222 days.

(21) Appl. No.: 17/052,517

(22) PCT Filed: Jul. 11, 2019

(86) PCT No.: PCT/JP2019/027475
§ 371 (c)(1),
(2) Date: Nov. 2, 2020

(87) PCT Pub. No.: WO2020/044810
PCT Pub. Date: Mar. 5, 2020

(65) Prior Publication Data

US 2021/0237387 A1 Aug. 5, 2021

(30) Foreign Application Priority Data

Aug. 30, 2018 (JP) ..... 2018-162151

(51) Int. Cl.
*B31B 50/59* (2017.01)
*B31B 120/10* (2017.01)

(52) U.S. Cl.
CPC ..... *B31B 50/592* (2018.05); *B31B 2120/10* (2017.08)

(58) Field of Classification Search
CPC ..... B31B 50/592; B31B 2121/10
See application file for complete search history.

(56) References Cited

U.S. PATENT DOCUMENTS 2,074,325 A 3/1937 Herman
3,850,340 A * 11/1974 Siemonsen ..... B65D 1/26 220/658

(Continued)

FOREIGN PATENT DOCUMENTS

CN 1418743 A 5/2003
CN 1736698 A 2/2006

(Continued)

OTHER PUBLICATIONS

Chinese Office Action (and English language translation thereof) dated Dec. 13, 2021, issued in Chinese Application No.201980034094.5 (which is a Chinese counterpart of related U.S. Appl. No. 17/052,521).

(Continued)

*Primary Examiner* — Joshua G Kotis
*Assistant Examiner* — Scott A Howell
(74) *Attorney, Agent, or Firm* — Holtz, Holtz & Volek PC

(57) ABSTRACT

A method for producing a paper lid includes a first step of holding down an outer edge area of a blank that is mainly made of paper, a second step of forming an inner fitting portion in a central area of the blank, while holding down the outer edge area, and a third step of forming an outer fitting portion in the central area, where the inner fitting portion is formed, while holding down the outer edge area.

8 Claims, 9 Drawing Sheets

(56) References Cited

U.S. PATENT DOCUMENTS

| | | | | |
|---|---|---|---|---|
| 5,904,643 | A * | 5/1999 | Seeberger | B31B 50/142 425/351 |
| 6,616,586 | B2 * | 9/2003 | Dai | B27N 5/00 425/398 |
| 7,914,432 | B2 | 3/2011 | Zelinski | |
| 8,900,505 | B2 * | 12/2014 | Li | B29C 43/003 264/318 |
| 10,368,668 | B2 | 8/2019 | Hyder et al. | |
| 10,889,412 | B2 | 1/2021 | West et al. | |
| 2005/0109653 | A1 * | 5/2005 | Wnek | B65D 21/0233 206/515 |
| 2009/0173775 | A1 * | 7/2009 | Swoboda | B31F 1/0077 229/407 |
| 2010/0243722 | A1 * | 9/2010 | Hyder | B65D 43/0208 493/171 |
| 2011/0193264 | A1 * | 8/2011 | Li | B29C 43/003 264/318 |
| 2015/0090776 | A1 | 4/2015 | Hyder et al. | |
| 2016/0000243 | A1 * | 1/2016 | Tedford, Jr. | B65D 43/0212 220/254.1 |
| 2017/0305097 | A1 * | 10/2017 | Räsänen | B31F 1/0077 |
| 2018/0086511 | A1 * | 3/2018 | Lin | D21J 3/10 |
| 2021/0237387 | A1 | 8/2021 | Tanaka et al. | |

FOREIGN PATENT DOCUMENTS

| | | | |
|---|---|---|---|
| CN | 106335702 | A | 1/2017 |
| EP | 3845371 | A1 | 7/2021 |
| FR | 2102036 | A5 | 3/1972 |
| GB | 1298790 | A | 12/1972 |
| GB | 1567162 | A | 5/1980 |
| JP | S3310183 | Y1 | 7/1958 |
| JP | S47199 | U | 4/1972 |
| JP | S538276 | A | 1/1978 |
| JP | S584230 | A | 1/1983 |
| JP | S58136457 | U | 9/1983 |
| JP | S6346364 | U | 3/1988 |
| JP | H08156955 | A | 6/1996 |
| JP | 3080882 | U | 10/2001 |
| JP | 2002307578 | A | 10/2002 |
| JP | 2002307579 | A | 10/2002 |
| JP | 3432316 | B2 | 8/2003 |
| JP | 2004106918 | A | 4/2004 |
| JP | 2005104476 | A | 4/2005 |
| WO | 2010111237 | A1 | 9/2010 |
| WO | 2014110592 | A1 | 7/2014 |

OTHER PUBLICATIONS

Office Action (Non-Final Rejection) dated Aug. 17, 2021 issued in related U.S. Appl. No. 17/052,521.

Chinese Office Action (and English language translation thereof) dated Jan. 13, 2022, issued in counterpart Chinese Application No. 201980033986.3.

International Search Report (ISR) (and English translation thereof) dated Oct. 1, 2019 issued in International Application No. PCT/JP2019/027475.

Written Opinion dated Oct. 1, 2019 issued in International Application PCT/JP2019/027475.

International Search Report (ISR) (and English translation thereof) dated Apr. 9, 2019 issued in International Application No. PCT/JP2019/009100.

Related U.S. Appl. No. 17/052,521, First Named Inventor: Yusuke Tanaka; Title: "Paper Lid"; filed Nov. 2, 2020.

Written Opinion dated Apr. 9, 2019 issued in International Application PCT/JP2019/009100.

Extended European Search Report dated Apr. 11, 2022, issued in counterpart European Application No. 19854916.4.

Extended European Search Report dated Jun. 1, 2022, issued in European Application No. 19857028.5 (which is a European counterpart of related U.S. Appl. No. 17/052,521).

* cited by examiner

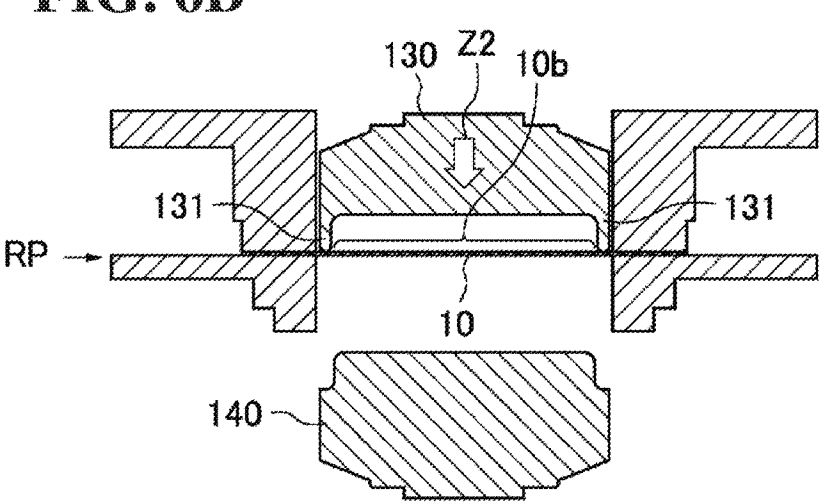
FIG. 6B
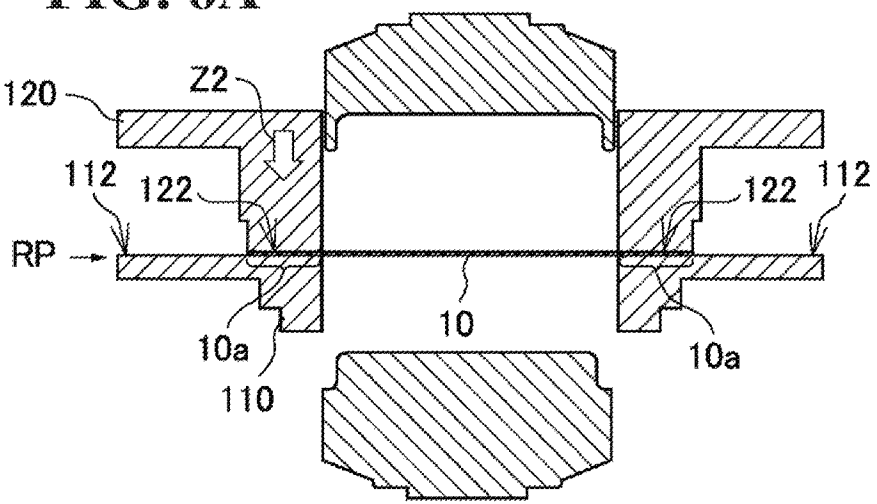
FIG. 6A
FIG. 6D
FIG. 6C

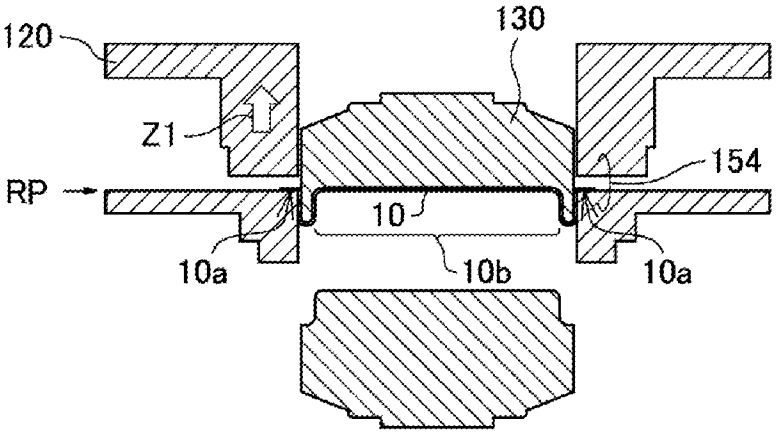
FIG. 7B
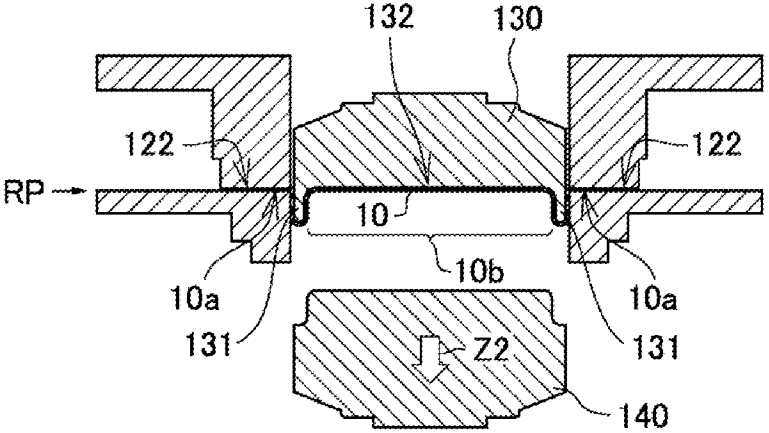
FIG. 7A
FIG. 7C
FIG. 7D

PAPER LID PRODUCTION METHOD

TECHNICAL FIELD

The present invention relates to a method for producing a paper lid.

BACKGROUND ART

A resin lid made of plastic or the like is used as a lid of a paper container such as a paper cup. However, when discarding this resin lid, it is necessary to separate it from the paper cup or the paper container, which is troublesome for the consumer.

Patent Literature 1 discloses a a method for producing a paper lid having a top plate and a groove portion, which, provided in a peripheral portion of the top plate, consists of an outer wall, an upper wall and an inner wall, and which is open downward.

CITATION LIST

Patent Literature

Patent Literature 1: Japanese Patent No. 3432316

SUMMARY OF INVENTION

Problem to be Solved by the Invention

In Patent Literature 1, a peripheral portion of the top plate is sandwiched between a male mold and a female mold, so that the inner wall, upper wall and outer wall of the groove portion are all formed in the peripheral portion of the top plate at the same time.

However, when the inner wall, upper wall and outer wall are all formed in the blank at the same time, the blank is likely to break. The inner wall corresponds to, for example, an inner fitting portion, and the outer wall corresponds to, for example, an outer fitting portion. Consequently, a circumstance arises in which a paper lid with both an inner fitting portion and an outer fitting portion is difficult to produce in high yield. This circumstance is particularly obvious when forming both the inner fitting portion and the outer fitting portion by using "ironing molding", while performing "wrinkle prevention" on the blank.

The present invention has been made in view of the above circumstance, and it is therefore an object of the present invention to provide a method for producing a paper lid, which makes it possible to produce, in high yield, a paper lid having both an inner fitting portion and an outer fitting portion.

Means for Solving the Problem

The method for producing a paper lid according to the first invention includes a first step of holding down an outer edge area of a blank that is mainly made of paper, a second step of forming an inner fitting portion in a central area of the blank, while holding down the outer edge area, and a third step of forming an outer fitting portion in the central area, where the inner fitting portion is formed, while holding down the outer edge area.

Based on the first invention, in the method for producing a paper lid according to a second invention, a first molding load is applied to the blank when forming the inner fitting portion, a second molding load is applied to the blank when forming the outer fitting portion, and a direction in which the second molding load is applied is opposite to a direction in which the first molding load is applied.

Based on the second invention, in the method for producing a paper lid according to a third invention, the inner fitting portion and the outer fitting portion are both formed in the blank by using drawing molding.

Based on the second invention, in the method for producing a paper lid according to a fourth invention, the inner fitting portion and the outer fitting portion are both formed in the blank by using ironing molding.

Based on the first invention or the second invention, in the method for producing a paper lid according to a fifth invention, the first step includes a step of holding down the outer edge area of the blank, which is laid on a mounting surface of a draw die, with a pressing surface of a blank holder and the second step includes the steps of positioning the central area of the blank between a draw punch, in which an annular protrusion portion is formed in a tip part, and a plunger, in which a reduced-diameter portion that can fit with the annular protrusion portion with a clearance is formed in the tip part, while holding down the outer edge area with the pressing surface, moving the plunger in a first direction toward the central area, and pushing the central area into a depression, which is surrounded by the annular protrusion portion and which has a punch surface of the draw punch at a bottom, and the third step includes the steps of moving the draw punch in a second direction, which is opposite to the first direction, toward the central area, while holding down the outer edge area with the pressing surface, and pushing the central area, together with the plunger, into the plunger guide hole of the draw die.

Based on the fifth invention, in the method for producing a paper lid according to a sixth invention, in the first step, a first clearance, which is equal to or less than a paper thickness of the blank, is formed between the mounting surface and the pressing surface.

Based on the fifth invention or the sixth invention, in the method for producing a paper lid according to a seventh invention, in the second step, a second clearance, which is equal to or less than the paper thickness of the blank, is formed between the reduced-diameter portion and the annular protrusion portion, and in the third step, a third clearance, which is equal to or less than the paper thickness of the blank, is formed between the annular protrusion portion and the plunger guide hole.

Based on one of the fifth invention to the seventh invention, in the method for producing a paper lid according to an eighth invention, the third step is a step of pushing the central area into the plunger guide hole of the draw die, together with the plunger, while leaving the outer edge area between the mounting surface and the pressing surface, the method further includes, after the third step, a fourth step of moving the plunger in the second direction, to part the plunger from the blank, while holding down the outer edge area with the pressing surface, a step of, moving the blank holder in the first direction, after the plunger is parted from the blank, to part the blank holder from the blank, while holding down the central area with the draw punch, a fifth step of placing the blank holder that has parted from the blank, in idle state, with a fourth clearance formed between the outer edge area and the pressing surface, and a sixth step of moving the draw punch in the first direction, after the blank holder is placed in idle state, to bring the outer edge area in contact with the pressing surface again, and to part the draw punch from the blank.

Advantageous Effects of Invention

With the method for producing a paper lid according to the first invention, the inner fitting portion is formed in the central area of the blank, and then the outer fitting portion is formed in the central area of the blank. Consequently, compared to the case in which the inner fitting portion and the outer fitting portion are formed in the central area of the blank at the same time, breaking of the blank and so forth are less likely to occur. Accordingly, a paper lid can be produced in high yield.

With the the method for producing a paper lid according to the second invention, the direction in which the second molding load is applied is opposite to the direction in which the first molding load is applied. Consequently, it is possible to make breaking of the blank less likely to occur, compared to the case in which the first molding load and the second molding load are both applied in the same direction.

With the method for producing a paper lid according to the third invention, the direction in which the second molding load is applied is opposite to the direction in which the first load is applied, so that it is possible to form the inner fitting portion and the outer fitting portion in the blank, by using drawing molding, while preventing breaking of the blank and so forth.

With the method for producing a paper lid according to the fourth invention, the direction in which the second molding load is applied is opposite to the direction in which the first load is applied, so that it is possible to form the inner fitting portion and the outer fitting portion in the blank, by using ironing molding, while preventing breaking of the blank and so forth.

With the method for producing a paper lid according to the fifth invention, the central area is surrounded by the annular protrusion portion and pushed into the depression where the punch surface of the draw punch is at the bottom, while holding down the outer edge area with the pressing surface. By this means, the inner fitting portion can be formed in the central area by using "drawing molding". Furthermore, the central area is pushed into the plunger guide hole, together with the plunger, while holding down the outer edge area with the pressing surface. By this means, the outer fitting portion can be formed in the central area by using "drawing molding".

With the method for producing a paper lid according to the sixth invention, the first clearance, which is equal to or less than the paper thickness of the blank, is formed between the mounting surface and the pressing surface, so that "wrinkle prevention" can be performed on the blank.

With the method for producing a paper lid according to the seventh invention, the second clearance, which is equal to or less than the paper thickness of the blank, is formed between the reduced-diameter portion and the annular protrusion portion, so that the inner fitting portion can be formed in the central area by using "ironing molding". In addition, the third clearance, which is equal to or less than the paper thickness of the blank, is formed between the annular protrusion portion and the plunger guide hole, so that the outer fitting portion can be formed in the central area using "ironing molding".

With the method for producing a paper lid according to the eighth invention, the outer fitting portion is formed in the central area, while leaving the outer edge area between the mounting surface and the pressing surface, so that it is possible to leave the outer edge area in the blank. Then, the remaining outer edge area is brought in contact with the pressing surface again, so that the blank can be easily removed from the draw punch, even if the annular protrusion portion is stuck in the annular recess portion.

BRIEF DESCRIPTION OF DRAWINGS

FIGS. 6A to 6D are schematic cross-sectional views that each show an example of the paper lid production method according to one embodiment of this invention;

FIGS. 7A to 7D are schematic cross-sectional views that each show an example of the paper lid production method according to one embodiment of this invention;

DESCRIPTION OF EMBODIMENTS

Hereinafter, one embodiment of this invention will be described with reference to the accompanying drawings.

(Example of Paper Lid)

Figure 1A:
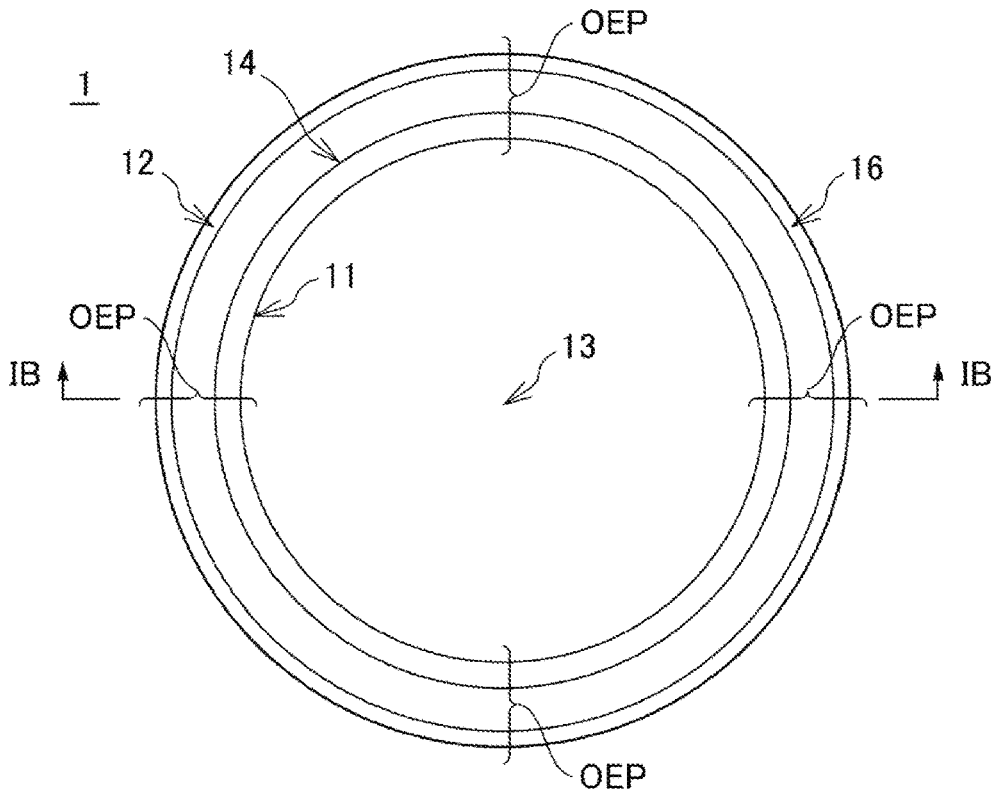
FIG. 1A is a schematic plan view to show an example of a paper lid that can be produced by the paper lid production method according to one embodiment of this invention.
Figure 1B:
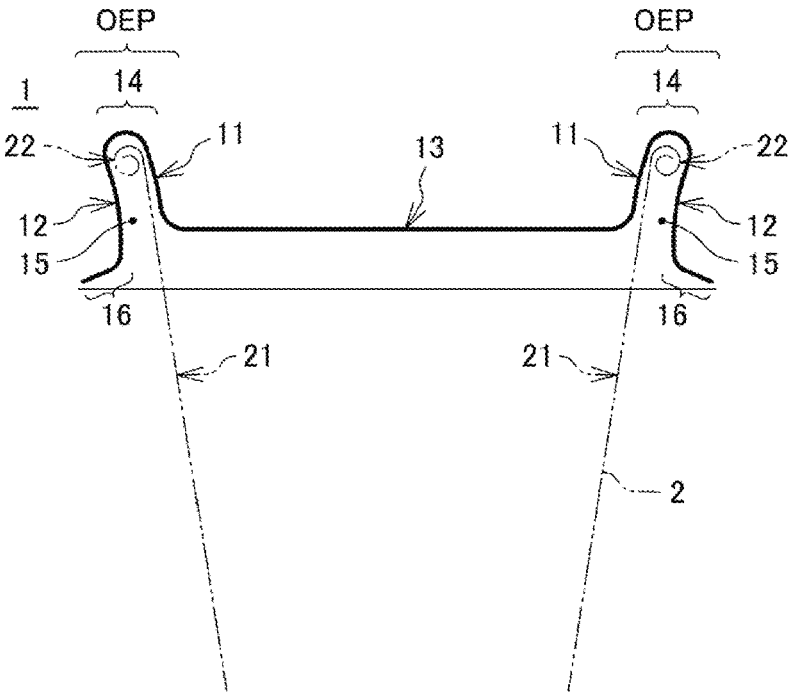
FIG. 1B is a schematic cross-sectional view taken along the line IB-IB in FIG. 1A.

FIG. 1A is a schematic plan view to show an example of a paper lid that can be produced by the paper lid production method according to one embodiment of this invention, and FIG. 1B is a schematic cross-sectional view taken along the line IB-IB in FIG. 1A.

As shown in FIGS. 1A and 1B, a paper lid 1 has an inner fitting portion 11 and an outer fitting portion 12. The inner fitting portion 11 and the outer fitting portion 12 are both provided in an outer edge portion OEP of the paper lid 1. The outer fitting portion 12 is provided on the outer side of the inner fitting portion 11. The inner fitting portion 11 and the outer fitting portion 12 have a shape to protrude from the top surface 13 of the paper lid 1. The peak portion of the inner fitting portion 11 and the peak portion of the outer fitting portion 12 are integrated. The integrated peak portion will be referred to as "peak portion 14" in this specification. In the present embodiment, the peak portion 14 has a rounded shape. Below the peak portion 14, an annular recess portion 15, having both the inner fitting portion 11 and the outer fitting portion 12 as surrounding walls, and having the peak portion 14 at the bottom, is provided between the inner fitting portion 12 and the outer fitting portion 14. The paper container 2 is fitted into the annular recess portion 15. The paper container 2 is, for example, a paper cup. The inner fitting portion 11 fits the inner peripheral surface 21 of the container portion of the paper container 2, and the outer fitting portion 12 fits the outer peripheral surface 21 of the curl portion of the paper container 2. Also, a flange portion 16 is provided in an end part of the paper lid 1.

Since the paper lid 1 has both the inner fitting portion 11 and the outer fitting portion 12, the paper lid 1 can fit with the paper container 2 firmly, compared to a paper lid with the inner fitting portion 11 alone or the outer fitting portion 12 alone.

(Example of Production Method)

Figure 2:
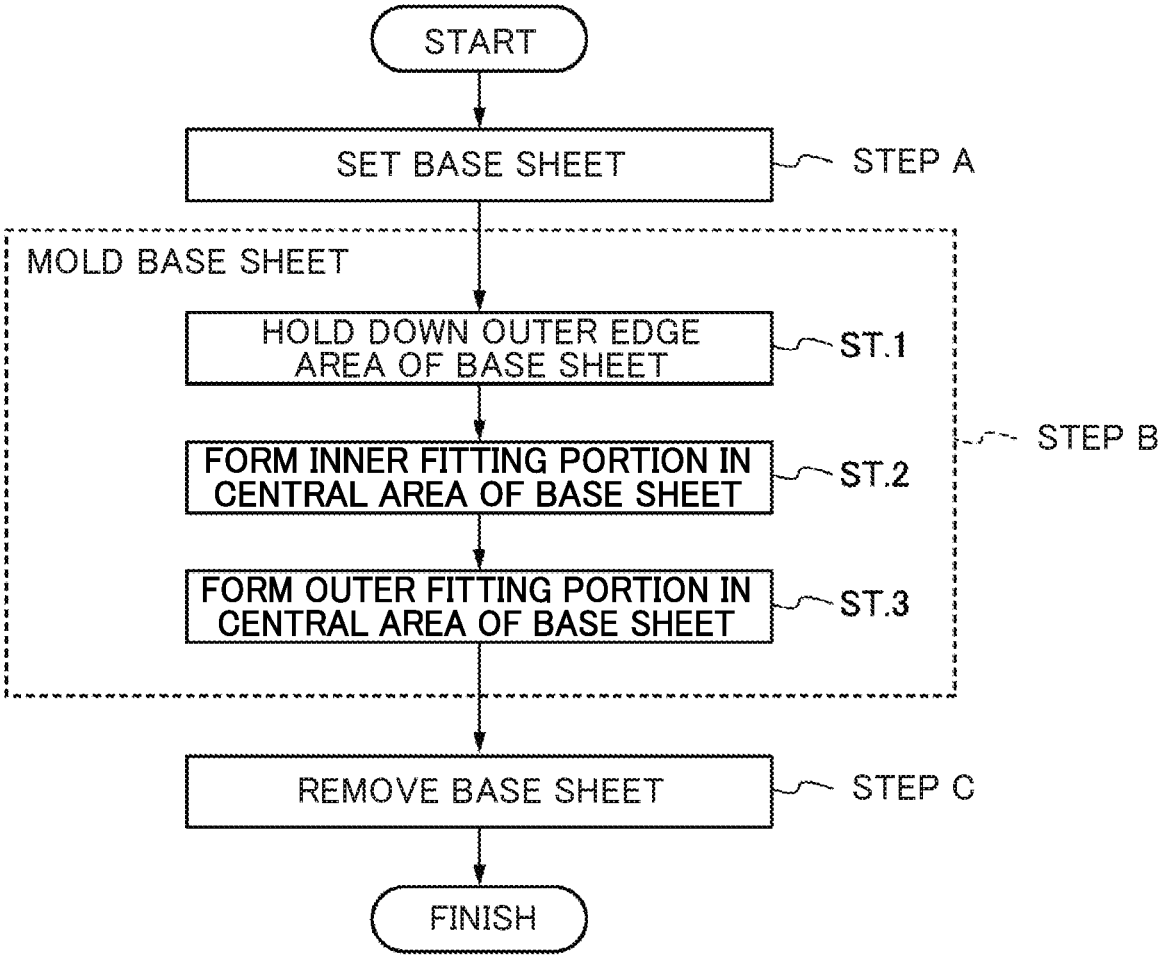
FIG. 2 is a flow chart to show, schematically, an example of the paper lid production method according to one embodiment of this invention.
Figure 3A:
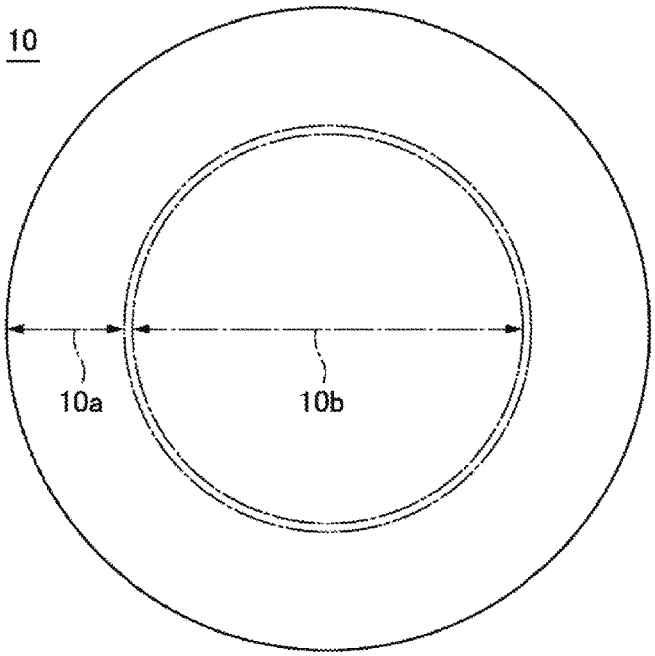
FIG. 3A is a schematic plan view to show an example of a blank.
Figure 3B:
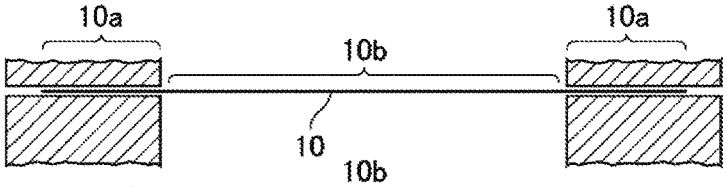
FIGS. 3B to 3D are schematic cross-sectional views to show the states of a blank in each process.
Figure 3C:
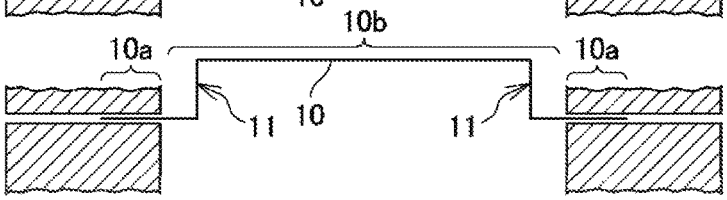
Figure 3D:
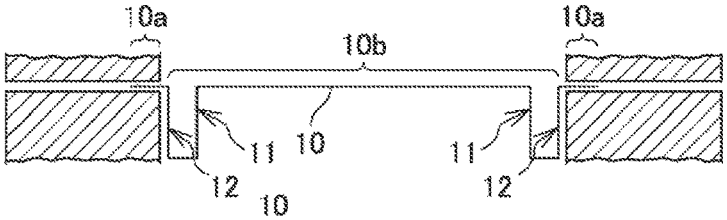
Figure 3E:
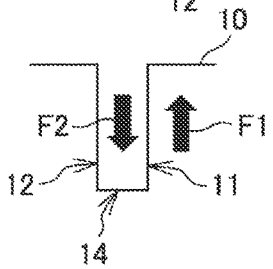
FIGS. 3E and 3F are schematic plan views to show the direction in which molding load is applied.
Figure 3F:
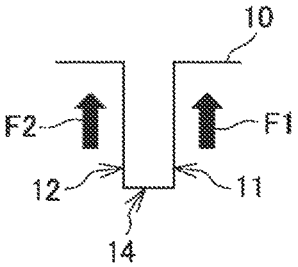

FIG. 2 is a flow chart to show, schematically, an example of the paper lid production method according to one embodiment of this invention. FIG. 3A is a schematic plan view to show an example of a blank. FIG. 3B to 3D are schematic cross-sectional views to show the states of a blank in each process. FIGS. 3E and 3F are schematic plan views to show the direction in which molding load is applied.

As shown in FIG. 2, the method for producing a paper lid roughly includes the steps A to C:

Step A: Step of setting a blank on a processing machine

Step B: Step of molding the blank on the processing machine

Step C: Step of removing the molded blank from the processing machine With the paper lid production method according to one embodiment, step B is performed as follows.

First, as shown in FIG. 3A, for example, a blank 10, which is circular when viewed in plan view, is punched out from a base sheet. Then, as shown in FIG. 2 and FIG. 3B, in step ST. 1, an outer edge area 10*a* of the blank 10 is held down. The outer edge area 10*a* is an area that is set virtually on the edge of the blank 10 (FIG. 3A). The outer edge area 10*a* refers to the area in the blank 10 that is held down. The shape of the outer edge area 10*a* is, for example, annular. Note that the process of punching out the blank 10 can be performed at the same time with step ST. 1. In this case, a blank holder, which will be described later, descends to punch out the blank 10 from the base sheet, and at the same time, to hold down the outer edge area 10*a* of the blank 10.

Next, as shown in FIG. 2 and FIG. 3C, in step ST. 2, the inner fitting portion 11 is formed in the central area 10*b* of the blank 10, while holding down the outer edge area 10*a*. The central area 10*b* is an area that is set virtually, inside the ring of the outer edge area 10*a* (FIG. 3A). The central area 10*b* refers to the area in the blank 10 that is not held down. The shape of the central area 10*b* is, for example, a circular.

Next, as shown in FIG. 2 and FIG. 3D, in step ST. 3, the outer fitting portion 12 is formed in the central area 10*b*, where the inner fitting portion 11 is formed, while holding down the outer edge area 10*a*.

With this paper lid production method, the inner fitting portion 11 is formed in the blank 10, and then the outer fitting portion 12 is formed in the blank 10. Consequently, compared to the case in which an inner fitting portion 11 and an outer fitting portion 12 are formed in the blank 10 at the same time, breaking of the blank and so forth are less likely to occur. Furthermore, even when compared to the case in which the inner fitting portion 11 is formed in the blank 10, after the outer fitting portion 12 is formed in the blank 10, breaking of the blank 10 and so forth are less likely to occur. It then follows that a paper lid 1 having both an inner fitting portion 11 and an outer fitting portion 12 can be produced in high yield.

As shown in FIGS. 3E and 3F, when the inner fitting portion 11 is formed by using "drawing molding" or "ironing molding", a first molding load F1 is applied to the blank 10. Likewise, when the outer fitting portion 12 is formed by using "drawing molding" or "ironing molding", a second molding load F2 is applied to the blank 10. "Drawing molding" as used in the present specification is defined as the kind of molding in which the clearances between molds (the draw die 110, the blank holder 120, the draw punch 130, and the plunger 140, which will be described later) are set to be equal to or greater than the paper thickness of the base sheet or the blank 10, and the base sheet or the blank 10 is placed in a clearance like this and molded. Furthermore, "ironing molding" is defined as the kind of molding in which at least one clearance between molds is set smaller than the above paper thickness, and the base sheet or the blank 10 is placed in this clearance and molded.

As shown in FIG. 3E, the direction in which the second molding load F2 is applied may be opposite to the direction in which the first molding load F1 is applied. If the direction in which the second molding load F2 is applied is opposite to the direction in which the first molding load F1 is applied, it is possible to make breaking of the blank 10 and so forth less likely to occur, compared to the case in which the first and second molding loads F1 and F2 are both applied in the same direction (FIG. 3F). Consequently, it is possible to further improve the yield of producing the paper lid 1 having both the inner fitting portion 11 and the outer fitting portion 12.

The inner fitting portion 11 and the outer fitting portion 12 are both formed while holding down the outer edge area 10*a* of the blank 10. Consequently, "wrinkle prevention" can be used to produce the paper lid 1. With the paper lid production method according to one embodiment, "drawing molding" or "ironing molding" is used for both the inner fitting portion 11 and the outer fitting portion 12, while performing "wrinkle prevention" on the blank 10. Furthermore, with the paper lid production method according to one embodiment, even if the inner fitting portion 11 and the outer fitting portion 12 are both formed by using "drawing molding" or "ironing molding", while performing "wrinkle prevention", the paper lid 1 can be produced in high yield. This advantage can be achieved even better by making the direction of applying the second molding load F2 opposite to the direction in which the first molding load F1 is applied.

Hereinafter, an example of the paper lid production method will be described in more detail.

<Example of Processing Machine>

Figure 4:
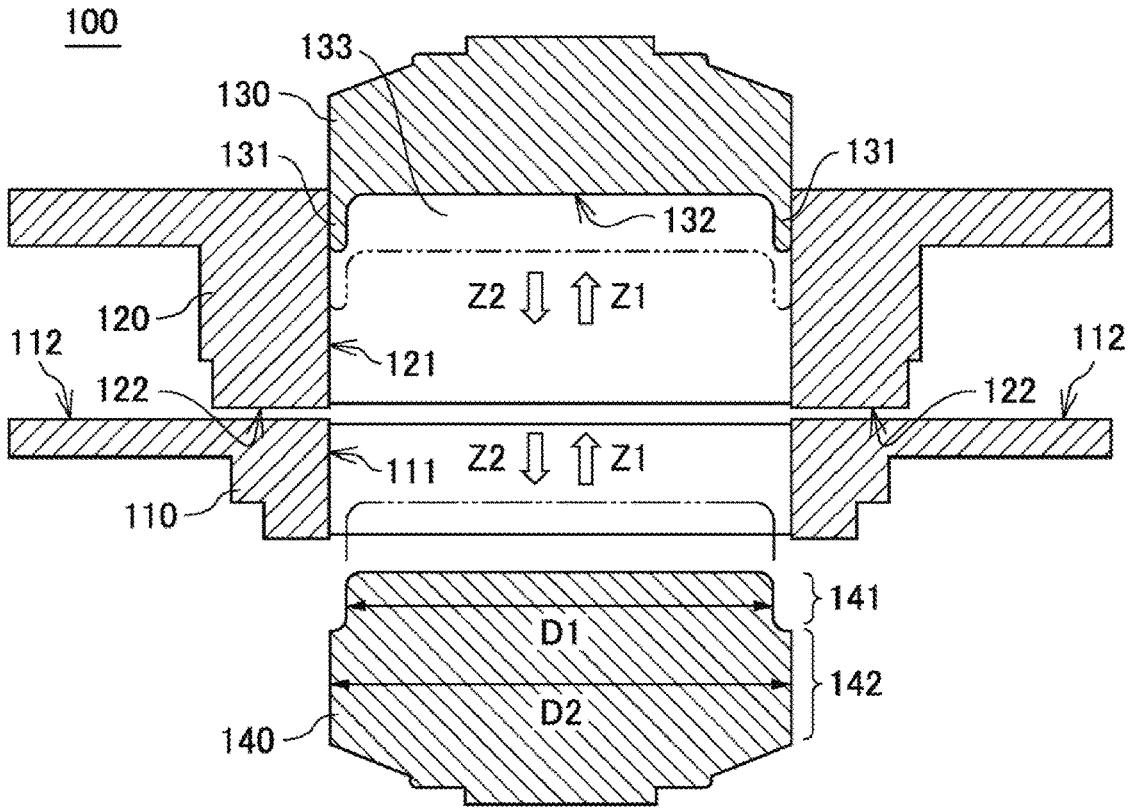
FIG. 4 is a schematic cross-sectional view to show an example of a processing machine that can be used in the paper lid production method according to one embodiment of this invention.

FIG. 4 is a schematic cross-sectional view to show an example of a processing machine that can be used in the paper lid production method according to one embodiment of this invention.

A processing machine 100 includes a draw die 110, a blank holder 120, a draw punch 130, and a plunger 140.

The draw die 110 has a plunger guide hole 111 and a mounting surface 112. The plunger guide hole 111 is, for example, a circular hole. The mounting surface 112 is provided outside the plunger guide hole 111. The mounting surface 112 faces the blank holder 120. The mounting surface 112 is a surface on which the blank 10 can be mounted.

The blank holder 120 has a punch guide hole 121 and a pressing surface 122. The punch guide hole 121 is a circular hole. The pressing surface 122 is provided outside the punch guide hole 121. The pressing surface 122 faces the mounting surface 112. The blank holder 120 holds down the blank 10 laid on the mounting surface 112.

The draw punch 130 can move in the punch guide hole 121 in both the first direction Z1 and the second direction Z2. The first direction Z1 and the second direction Z2 both intersect (for example, are orthogonal to) the mounting surface 112. The second direction Z2 is opposite to the first direction Z1. An annular protrusion portion 131 is provided in a tip part of the draw punch 130. The annular protrusion portion 131, for example, protrudes like a surrounding wall from the punch surface 132 of the draw punch 130. By this means, a depression 133, which is surrounded by the annular protrusion portion 131, and which has the punch surface 132 at the bottom, is formed in the tip part of the draw punch 130. The annular protrusion portion 131 can be fitted to the inner peripheral surface of the plunger guide hole 111 with a clearance. The tip of the annular protrusion portion 131 has a curved surface.

The plunger 140 can move in the plunger guide hole 111 in both the first direction Z1 and the second direction Z2. A reduced-diameter portion 141 is provided in the tip part of the plunger 140. The diameter D1 of the reduced-diameter portion 141 is smaller than the diameter D2 of the base diameter portion 142 of the plunger 140. The reduced-diameter portion 141 can be fitted to the annular protrusion portion 131 with a clearance.

The processing machine 100 is, for example, a press machine. For example, by using the processing machine 100 shown in FIG. 4, the paper lid 1 having both the inner fitting portion 11 and the outer fitting portion 12 can be produced from the blank 10.

Figure 5:
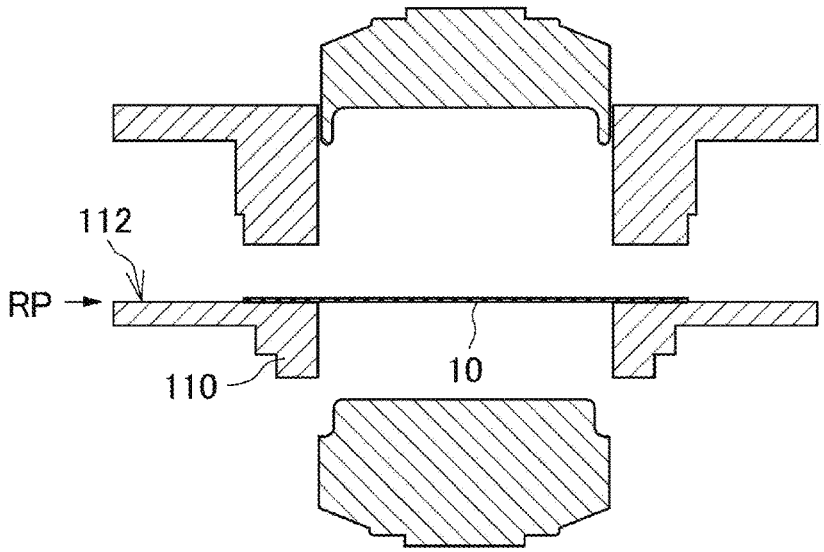
FIG. 5 is a schematic cross-sectional view to show an example of the paper lid production method according to one embodiment of this invention.

FIG. 5, FIGS. 6A to 6D, and FIGS. 7A to 7D are schematic cross-sectional views to show examples of the paper lid production method according to one embodiment of this invention. FIG. 5. FIGS. 6A to 6D and FIGS. 7A to 7D show schematic cross sections of the blank 10 and schematic cross sections of the processing machine 100, respectively.

<Step A>

As shown in FIG. 5, the blank 10 is laid on the mounting surface 112 of the draw die 110. Note that, in the following description, the position of the mounting surface 112 serves as a reference position RP.

<Step B>

Next, as shown in FIG. 6A, the blank holder 120 is moved in the second direction Z2, and the outer edge area 10*a* of the blank 10 is held down by the pressing surface 122 of the blank holder 120.

Figure 8A:
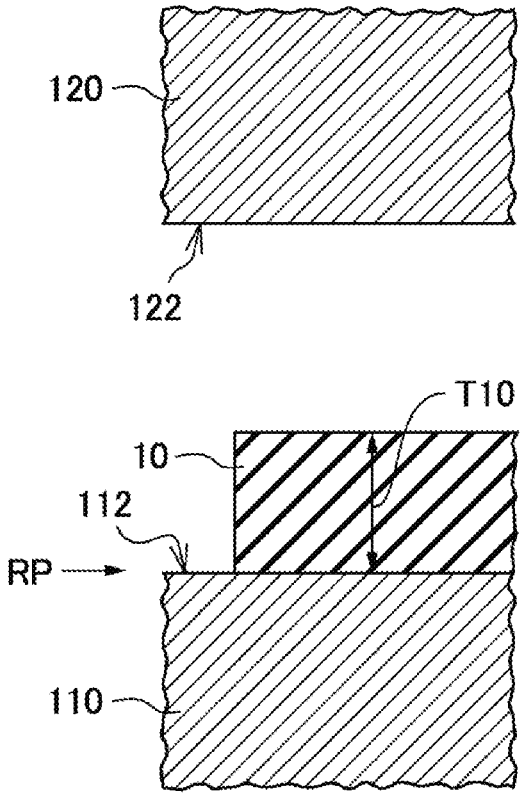
FIGS. 8A and 8B are schematic cross-sectional views to show partially enlarged views of a mounting surface and a pressing surface, respectively.
Figure 8B:
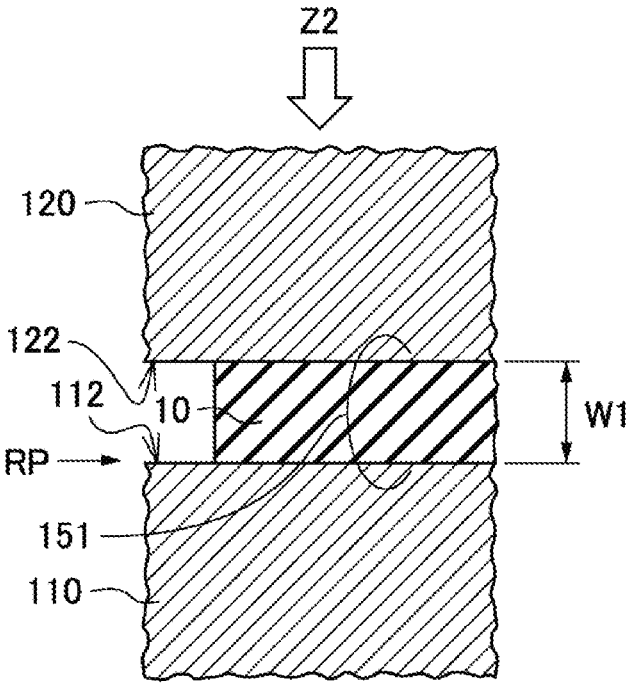

FIGS. 8A and 8B are schematic cross-sectional views to show partially enlarged views of the blank 10, the draw die, and the blank holder, respectively. FIG. 8A shows a state in which the blank 10 is laid on the mounting surface 112, and FIG. 8B shows a state in which the outer edge area 10*a* is held down by the pressing surface 122.

As shown in FIG. 8B, when the blank 10 is held down by the pressing surface, a first clearance 151 is formed between the mounting surface 112 and the pressing surface 122. The width W1 of the first clearance 151 is set smaller than the paper thickness T10 of the blank 10 (FIG. 8A). By this means, the blank 10 is crushed, and "wrinkle prevention" can be applied to the blank 10. Note that the blank holder 120 may be given a load for "wrinkle prevention", and the width W1 of the first clearance 151 may be equal to the paper thickness T10 of the blank 10, or may be greater than the paper thickness T10.

Next, as shown in FIG. 6B, the draw punch 130 is moved in the second direction Z2, toward the blank 10. By this means, the draw punch 130 is lowered so that, for example, the tip of the annular protrusion portion 131 substantially reaches the reference position RP. By this means, the tip of the annular protrusion portion 131 is in contact with or close to the surface of the blank 10. Note that, in the state shown in FIG. 6B, the central area 10*b* of the blank 10 is located between the draw punch 130 and the plunger 140.

Next, as shown in FIG. 6C, the plunger 140 is moved in the first direction Z1, toward the blank 10. By this means, the plunger 140 is lifted so that the tip of the reduced-diameter portion 141 passes the reference position RP. When the reduced-diameter portion 141 passes, for example, the reference position RP, the reduced-diameter portion 141 advances into the depression 133. By this means, the central area 10*b* of the blank 10 is pushed by the reduced-diameter portion 141 into the depression 133. Here, if the tip part (annular protrusion portion 131) of the draw punch 130 is a curved surface, and the tip corner portion of the reduced-diameter portion 141 of the plunger 140 is also a curved surface (R-processed), the central area 10*b* of the blank 10 can be pushed in smoothly. The degree of the push is about 10 mm according to the present embodiment. Note that the degree of push is changed variously depending on the size of the paper lid 1, the use of the paper lid 1 and so forth.

In this manner, the central area 10*b* is pushed into the depression 133, while holding down the outer edge area 10*a* with the pressing surface 122. By this means, the inner fitting portion 11 can be formed in the central area 10*b*, by using "drawing molding", while performing "wrinkle prevention" on the outer edge area 10*a*.

Figure 9B:
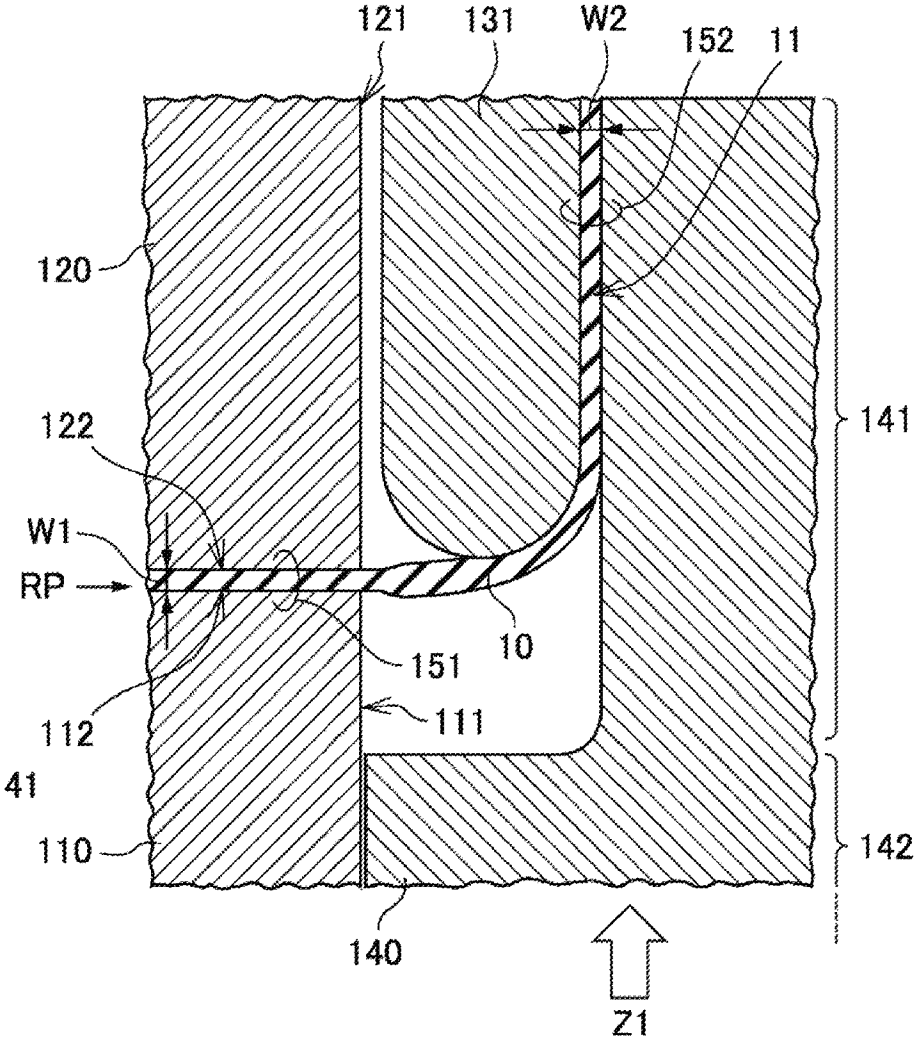
FIGS. 9A and 9B are schematic cross-sectional views to show partially enlarged views of a draw die, a blank holder, an annular protrusion portion and a plunger, respectively.
Figure 9A:
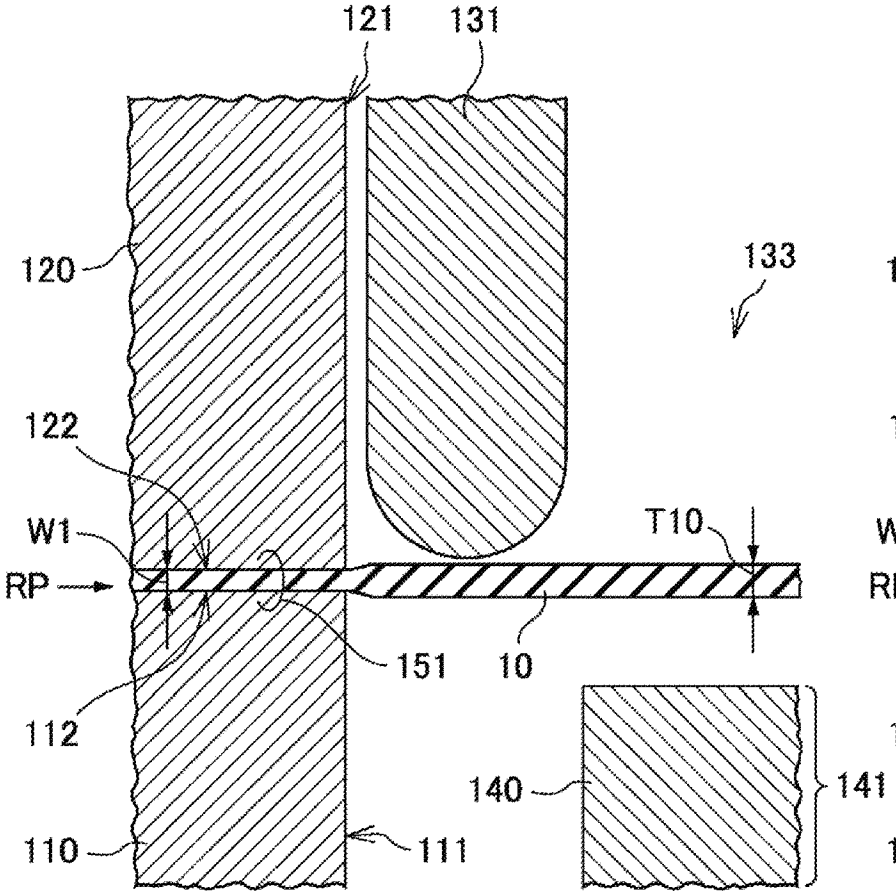

FIGS. 9A and 9B are schematic cross-sectional views to show partially enlarged views of a draw die 110, a blank holder 120, an annular protrusion portion 131 and a plunger 140, respectively. FIG. 9A shows the state before the push, and FIG. 9B shows the state during the push.

As shown in FIG. 9B, a second clearance 152 is formed between the reduced-diameter portion 141 and the annular protrusion portion 131. The width W2 of the second clearance 152 is set to be equal to the paper thickness T10 of the blank 10 (FIG. 8A) or smaller than the paper thickness T10 (W2≤T10). By this means, the inner fitting portion 11 can be formed in the central area 10*b*, by using "ironing molding", while performing "wrinkle prevention" on the outer edge area 10*a*.

When forming the inner fitting portion 11 by using "drawing molding" or "ironing molding", a first molding load F1 is applied to the plunger 140. The direction in which the first molding load F1 is applied is the first direction Z1. An example of the value of the first molding load F1 is, for example, approximately 3 kN. The magnitude of the first molding load F1 also changes variously, depending on the size of the paper lid 1, the use of the paper lid 1, and so forth. The first molding load F1 is applied from a loader (not shown) to the plunger. An example of the loader is a loader that applies a load to an object via an elastic body. An air cylinder is an example of such a loader. The air cylinder contains air as an elastic body. Note that the loader is also used as a moving mechanism for moving the plunger 140 in the first direction Z1 and the second direction Z2.

Next, as shown in FIG. 6D, the draw punch 130 is moved in the second direction Z2, toward the blank 10. The second direction Z2 is opposite to the first direction Z1. By this means, the draw punch 130 is lowered so that, for example, the tip of the annular protrusion portion 131 passes the reference position RP. The draw punch 130 pushes the blank 10, together with the plunger 140, into the plunger guide hole 111. The degree of the push is about 10 mm from the reference position RP, according to the present embodiment. Note that the degree of push is changed variously depending on the size of the paper lid 1, the use of the paper lid 1 and so forth.

In this manner, the central area 10*b* is pushed into the plunger guide hole 111, together with the plunger 140, while holding down the outer edge area 10*a* with the pressing surface 122. By this means, the outer fitting portion 12 can be formed in the central area 10*b*, by using "drawing molding", while performing "wrinkle prevention" on the outer edge area 10*a*.

Figure 10:
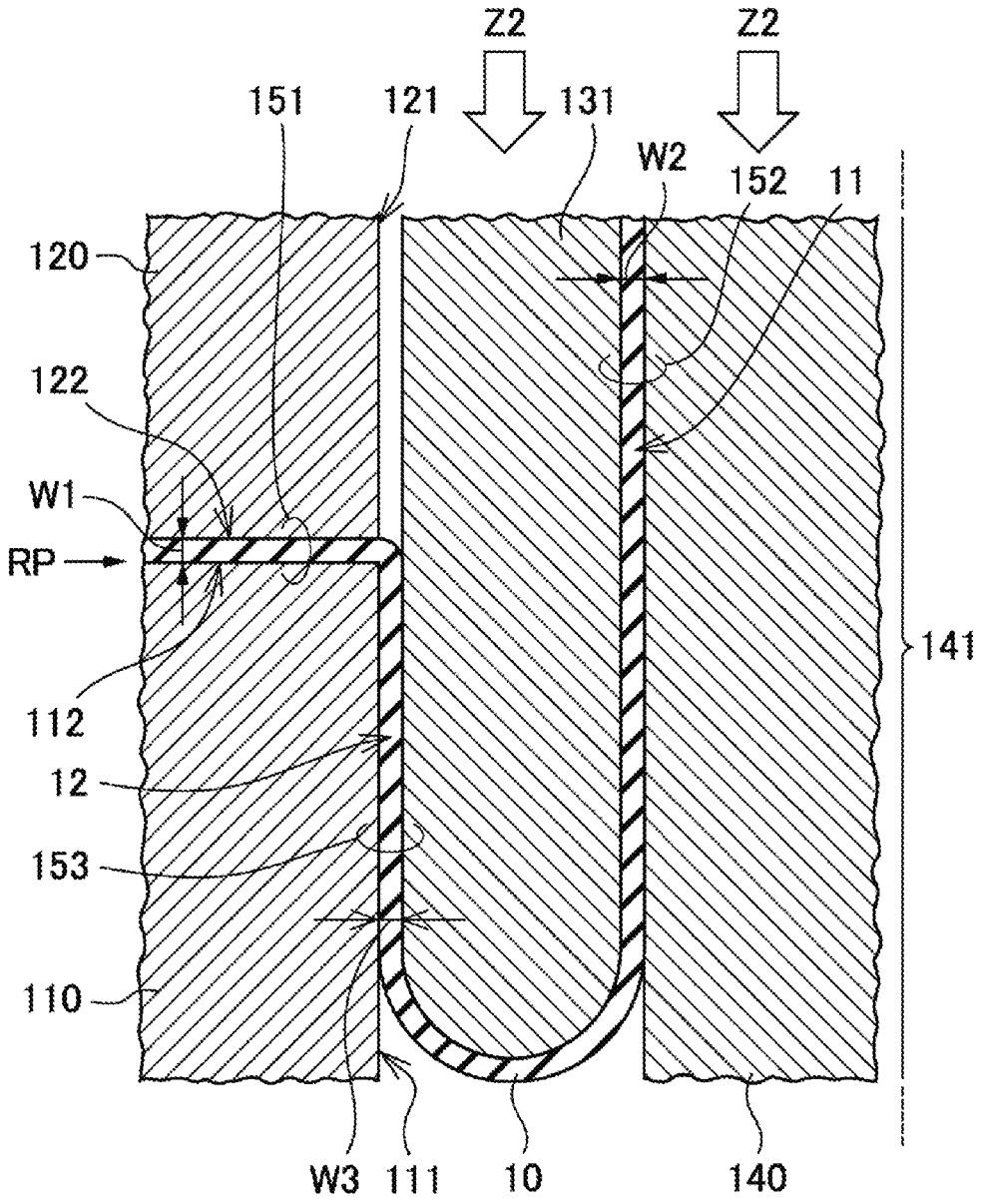
FIG. 10 is a schematic cross-sectional view to show partially enlarged views of a draw die, a blank holder, an annular protrusion portion and a reduced-diameter portion, respectively.

FIG. 10 is a schematic cross-sectional view to show partially enlarged views of a draw die 110, a blank holder 120, an annular protrusion portion 131 and a reduced-diameter portion 141, respectively. FIG. 10 shows the state after the push, or the state during the push.

As shown in FIG. 10, a third clearance 153 is formed between the annular protrusion portion 131 and the plunger guide hole 111. The width W3 of the third clearance 153 is set to be equal to the paper thickness T10 of the blank 10 (FIG. 8A) or smaller than the paper thickness T10 (W3≤T10). By this means, the outer fitting portion 12 can be formed in the central area 10*b*, by using "ironing molding", while performing "wrinkle prevention" on the outer edge area 10*a*.

When the outer fitting portion 12 is formed by using "drawing molding" or "ironing molding", a second molding load F2 is applied to the draw punch 130. The direction in which the second molding load F2 is applied is the second direction Z2. The direction in which the second molding load F2 is applied is opposite to the direction in which the first molding load F1 is applied. An example of the value of the second molding load F2 is, for example, approximately 6.5 kN. The magnitude of the second molding load F2 also changes variously, depending on the size of the paper lid 1, the use of the paper lid 1, and so forth. The second molding load F2 is applied from a loader (not shown) to the plunger. An example of the loader is a loader that can apply a load to an object in a mechanical way. A servo press is an example of such a loader. The servo press includes a servo motor. Note that the loader is also used as a moving mechanism for moving the draw punch 130 in the second direction Z2 and the first direction Z1. Furthermore, when a servo motor is used, for example, it is possible to control the lowering of the draw punch 130 precisely, in two steps. The first stage is the descent to the reference position RP, and the second stage is more precise descent beyond the reference position RP, down to the final descent position. With a servomotor, the draw punch 130 can be reliably stopped and kept at the final descent position.

The magnitude of the second molding load F2 may be greater than the first molding load F1. In this case, if the plunger 140 is supported by a moving mechanism including an elastic body such as an air cylinder, or by a loader, the difference between the second molding load F2 and the first molding load F1 can press down the plunger 140. Consequently, the tip of the annular protrusion portion 131 can be pushed into the plunger guide hole 111, while maintaining the state in which the molds are clamped (the state in which the central area 10*b* is sandwiched between the draw punch 130 and the plunger 140). Moreover, since the plunger 140 is pressed down by the draw punch 130, the advantage of making it unnecessary to control the position of the plunger 140 can be achieved.

When the outer fitting portion 12 is formed, the central area 10*b* is pushed into the plunger guide hole 111, together with the plunger 140, while leaving the outer edge area 10*a* between the mounting surface 112 and the pressing surface 122. In this case, the flange portion 16 is formed in an end part of the blank 10. If the blank 10 has a flange portion 16, the blank 10 can be removed as follows during the process of removing the blank 10 (step C).

<Step C>

Next, as shown in FIG. 7A, the plunger 140 is moved in the second direction Z2, while holding down the outer edge area 10*a* with the pressing surface 122. By this means, the plunger 140 is parted from the blank 10. The draw punch 130 is kept at the final descent position. Consequently, the draw punch 130 stays in contact with, for example, the central area 10*b*. If the draw punch 130 is kept at the final descent position, the blank 10 will not fall even if the plunger 140 parts from the blank 10.

Next, as shown in FIG. 7B, the blank holder 120 is moved in the first direction Z1 while holding the draw punch 130 at the final descent position. By this means, the blank holder 120 is parted from the blank 10. Then, the blank holder 120 is placed in idle state with a fourth clearance 154 formed between the outer edge area 10*a* and the pressing surface 122.

Next, as shown in FIG. 7C, the draw punch 130 is moved in the first direction Z1. At this time, the annular protrusion portion 131 is often stuck into the annular recess portion 15 (see FIG. 1B or FIG. 7D for the annular recess portion 15). If the annular protrusion portion 131 is stuck into the annular recess portion 15, the blank 10 moves in the first direction Z1 while being stuck to the draw punch 130.

Next, as shown in FIG. 7D, the draw punch 130 is moved further in the first direction Z1. In this embodiment, the flange portion 16 is formed in an end part of the blank 10 (see FIG. 1B for the flange portion 16). The flange portion 16 is an outer edge area 10*a*. Consequently, by moving the draw punch 130 in the first direction Z1 further, it is possible to bring the outer edge area 10*a* into contact with the pressing surface 122 again. The annular protrusion portion 131 is pulled out of the annular recess portion 15, while the outer edge area 10*a* (flange portion 16) is supported by the pressing surface 122. Eventually, the blank 10 parts from the draw punch 130. By this means, the blank 10 is ready to be removed from the processing machine 100.

In this way, the outer fitting portion 12 is formed in the central area 10*b* while leaving the outer edge area 10*a* between the mounting surface 112 and the pressing surface 122, so that the outer edge area 10*a* is left in the blank 10 in the end. The remaining outer edge area 10*a* is brought into contact with the pressing surface 122 again, so that, even if the annular protrusion portion 131 is stuck in the annular recess portion 15, the blank 10 can be easily removed from the draw punch 130. It is not necessary to provide a blank-removing mechanism for parting the blank 10, such as a knockout, in the draw punch 130.

In this way, by following the paper lid production method according to one embodiment, a paper lid 1 with both an inner fitting portion 11 and an outer fitting portion 12 is produced.

The paper lid 1 is used, for example, as a lid for the paper container 2. The paper container 2 may contain liquid, for example. Consequently, paper called "water resistant paper", including for example, hydrophobic paper, water-repellent paper, paper with a surface subjected to waterproof finishing, paper with a surface subjected to water-repellent finishing and so forth is preferable for the paper to use for the paper lid 1. Also, laminated paper, in which resin is laminated on the surface of the paper, coated paper that is coated with resin and so forth may be used. However, the paper to use for the paper lid 1 can be changed as appropriate depending on the needs of consumers. The paper to use for the paper lid 1 is therefore not limited to water resistant paper, laminated paper, and coated paper.

According to one embodiment like this, it is possible to provide a method for producing a paper lid 1, which makes it possible to produce, in high yield, a paper lid 1 with both an inner fitting portion 11 and an outer fitting portion 12.

Now, although an embodiment of the present invention has been described above, the embodiment has been presented simply by way of example, and is not intended to limit the scope of the invention. Furthermore, the above embodiment is not the only embodiment of this invention. Furthermore, this invention can be implemented in a variety of new forms other than the above embodiment. Accordingly, a variety of omissions, replacements, changes and so forth can be applied to the above embodiment without departing from the spirit of the present invention. Such new forms and changes are included in the scope and spirit of this invention, and are also included in the scope of the invention described in the claims and equivalents of the invention recited in the claims.

REFERENCE SIGNS LIST

1: paper lid
- 11: inner fitting portion
- 12: outer fitting portion
- 13: top surface
- 14: peak portion
- 15: annular recess portion
- 16: flange portion

2: paper container
- 21: inner peripheral surface of container portion
- 22: outer peripheral surface of curl portion

10: blank
- 10*a*: outer edge area
- 10*b*: central area

100: processing machine
- 110: draw die
  - 111: plunger guide hole
  - 112: mounting surface
- 120: blank holder
  - 121: punch guide hole
  - 122: pressing surface
- 130: draw punch
  - 131: annular protrusion portion
  - 132: punch surface
  - 133: depression
- 140: plunger
  - 141: reduced-diameter portion
  - 142: base diameter portion
- 151: first clearance
- 152: second clearance
- 153: third clearance OEP: outer edge portion
F1: first molding load
F2: second molding load
Z1: first direction
Z2: second direction
D1: diameter of reduced-diameter portion 141
D2: diameter of base diameter portion 142
T10: paper thickness
W1: width of first clearance
W2: width of second clearance
W3: width of third clearance
RP: reference position

The invention claimed is:

1. A method for producing a paper lid, the method comprising:
- a first step of holding down an outer edge area of a blank that is mainly made of paper with a pressing surface of a blank holder;
- a second step of forming an inner fitting portion in a central area of the blank using a draw punch, while holding down the outer edge area with the pressing surface;
- a third step of forming an outer fitting portion in the central area, where the inner fitting portion is formed, while holding down the outer edge area with the pressing surface; and
- after the third step, a step of separating the pressing surface from the outer edge area and re-contacting the outer edge area with the pressing surface to separate the draw punch from the blank.

2. The method for producing the paper lid according to claim 1, wherein:
- a first molding load is applied to the blank when forming the inner fitting portion;
- a second molding load is applied to the blank when forming the outer fitting portion; and
- a direction in which the second molding load is applied is opposite to a direction in which the first molding load is applied.

3. The method for producing the paper lid according to claim 2, wherein the inner fitting portion and the outer fitting portion are both formed in the blank by using drawing molding.

4. The method for producing the paper lid according to claim 2, wherein the inner fitting portion and the outer fitting portion are both formed in the blank by using ironing molding.

5. A method for producing a paper lid, the method comprising:
- a first step of holding down an outer edge area of a blank that is mainly made of paper with a pressing surface of a blank holder;
- a second step of forming an inner fitting portion in a central area of the blank by positioning the central area between a draw punch and a plunger and moving the plunger in a first direction toward the draw punch with the central area therebetween, while holding down the outer edge area with the pressing surface;
- a third step of forming an outer fitting portion in the central area, where the inner fitting portion is formed, while holding down the outer edge area with the pressing surface;
- after the third step, a fourth step of separating the plunger from the blank, and separating the blank holder from the blank after separating the plunger from the blank;
- a fifth step of making the blank holder having been separated from the blank stand by; and
- a sixth step in which the draw punch is moved in the first direction after the blank holder is made to stand by, whereby the outer edge area is re-contacted with the pressing surface of the blank holder and the draw punch is separated from the blank.

6. The method for producing the paper lid according to claim 5, wherein:

a first molding load is applied to the blank when forming the inner fitting portion;

a second molding load is applied to the blank when forming the outer fitting portion; and a direction in which the second molding load is applied is opposite to a direction in which the first molding load is applied.

7. The method for producing the paper lid according to claim 6, wherein the inner fitting portion and the outer fitting portion are both formed in the blank by using drawing molding.

8. The method for producing the paper lid according to claim 6, wherein the inner fitting portion and the outer fitting portion are both formed in the blank by using ironing molding.

* * * * *